US012186652B2

(12) United States Patent
Riordan et al.

(10) Patent No.: US 12,186,652 B2
(45) **Date of Patent: *Jan. 7, 2025**

(54) MULTI-DECK AUTOMATIC SMART CARD SHUFFLER AND SECURITY SYSTEM CONFIGURED TO SHUFFLE AND DELIVER HANDS FOR A CASINO TABLE GAME SUCH AS BACCARAT

(71) Applicant: Shark Trap Gaming & Security Systems, LLC, Las Vegas, NV (US)

(72) Inventors: Michael Earnest Riordan, Las Vegas, NV (US); Louis Wilson DeGregorio, Las Vegas, NV (US); Steven Louis Forte, Las Vegas, NV (US); Dino Louis DeGregorio, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/804,058

(22) Filed: May 25, 2022

(65) Prior Publication Data

US 2022/0288483 A1 Sep. 15, 2022

Related U.S. Application Data

(63) Continuation of application No. 17/303,221, filed on May 24, 2021, now Pat. No. 11,389,716, which is a continuation of application No. 16/927,888, filed on Jul. 13, 2020, now Pat. No. 11,013,982, which is a continuation of application No. 16/162,300, filed on Oct. 16, 2018, now Pat. No. 10,709,962.

(51) Int. Cl.

| | |
|---|---|
| ***A63F 1/12*** | (2006.01) |
| ***A63F 1/00*** | (2006.01) |
| ***A63F 1/14*** | (2006.01) |

(52) U.S. Cl.
CPC ..... *A63F 1/12* (2013.01); *A63F 1/14* (2013.01); *A63F 2001/001* (2013.01)

(58) Field of Classification Search
CPC ..... A63F 1/12; A63F 1/14; A63F 2001/001
USPC ..... 273/149 R
See application file for complete search history.

(56) References Cited

U.S. PATENT DOCUMENTS 3,386,609 A * 6/1968 Noah ..... B65H 49/38 312/297
4,951,950 A * 8/1990 Normand ..... A63F 1/14 273/149 P (Continued)

*Primary Examiner* — Michael D Dennis
(74) *Attorney, Agent, or Firm* — FisherBroyles, LLP; Rob L. Phillips

(57) ABSTRACT

A card shuffler and dealing module shuffles eight decks of cards (or less) and delivers Baccarat hands (or other games) to a dealer. Cards are randomly selected from two pre-shuffle bins and delivered to a connected or integral dealing module. The card shuffler initially selects and delivers four cards (the minimum number needed for a hand of Baccarat) to a dealing area of the dealing module. Two additional cards (the maximum number of additional cards needed for a hand of Baccarat) are then selected and delivered to the dealing module rear of the four initial cards. Accordingly, up to six cards are available to be dealt during the Baccarat hand. The smart card shuffler tracks the rank of the cards and discerns the future outcome of the Baccarat game and adjusts the cards made available to the dealer via an automatic dealing module cover and card transport mechanism.

10 Claims, 7 Drawing Sheets

(56) References Cited

U.S. PATENT DOCUMENTS

| | | | | |
|---|---|---|---|---|
| 6,254,096 | B1 * | 7/2001 | Grauzer | A63F 1/12 273/149 R |
| 8,342,526 | B1 * | 1/2013 | Sampson | A63F 1/12 273/149 R |
| 9,573,047 | B1 * | 2/2017 | Riordan | A63F 1/14 |
| 2008/0006997 | A1 * | 1/2008 | Scheper | A63F 1/10 273/149 R |
| 2008/0284096 | A1 * | 11/2008 | Toyama | A63F 1/12 273/149 R |

* cited by examiner 300
303
310
330
320
301
305
302

303
360
302
330
301
322
320
321
330
340
360
350

321
320

MULTI-DECK AUTOMATIC SMART CARD SHUFFLER AND SECURITY SYSTEM CONFIGURED TO SHUFFLE AND DELIVER HANDS FOR A CASINO TABLE GAME SUCH AS BACCARAT

CROSS-REFERENCES

This application is a continuation of, and claims priority to, U.S. patent application Ser. No. 17/303,221 filed May 24, 2021, which is a continuation of, and claims priority to, U.S. patent application Ser. No. 16/927,888 filed Jul. 13, 2020, now U.S. Pat. No. 11,013,982, which is a continuation of, and claims priority to, U.S. patent application Ser. No. 16/162,300 filed Oct. 16, 2018, now U.S. Pat. No. 10,709,962.

FIELD OF INVENTION

The embodiments of the present invention relate to an automatic card shuffler for shuffling and delivering hands of a card game such as Baccarat.

BACKGROUND

Automatic card shufflers have been used by casinos for decades and have helped revolutionize the gaming industry. Automatic card shufflers speed up play of casino games and may reduce cheating and advantage play. Automated shufflers may be configured to sit on a casino table or be incorporated therein.

Baccarat is a game dominated by high roller play and often results in a casino's highest table game profit or loss. Thus, speed of play, security and card costs associated with baccarat are significant issues facing every casino offering the game.

It would be advantageous to develop an automatic card shuffler configured to shuffle and deal hands of a card game, namely baccarat, while increasing security and speed of play, and reducing card costs.

SUMMARY

Applicant's U.S. patent Ser. No. 10/092,820 discloses a multi-deck automatic card shuffler and is incorporated herein by reference for all purposes. The manner in which the cards are randomly selected (i.e. shuffled) by the card shuffler described in U.S. patent Ser. No. 10/092,820 is the same for the present invention described herein.

In one embodiment, a card shuffler of the present invention is configured to shuffle eight decks of cards (or less) and deal hands or rounds of Baccarat. A hand or round being equal to a number of cards (i.e., 6) sufficient to deal a Baccarat hand in a traditional manner. In this embodiment, the automatic shuffler comprises two pre-shuffle bins, each configured to receive approximately four decks of cards wherein the pre-shuffle bins are spaced apart from one another, each near a card slide leading to a card-receiving area. Cards are randomly selected from the cards in each of the pre-shuffle bins and propelled against a respective card slide delivering the cards to a connected or integral dealing module. The card shuffler initially selects four cards (the minimum number needed for a hand of Baccarat) which are delivered to a dealing area of the dealing module. Two additional cards (the maximum number of additional cards needed for a hand of Baccarat) are then selected and delivered to the dealing module rear of the four initial cards. Accordingly, up to six cards are available to be dealt during the Baccarat hand.

Unlike a dealing shoe, in one embodiment, the dealing area or the dealing module has no bottom so that the four initial cards lay flat, in a stack, on the casino table rather than rest at an angle in a card shoe. Once the four initial cards are delivered in a stacked arrangement to the dealing area of the dealing module, a dealing module cover retracts to expose the four stacked cards for access by the dealer. Once the four cards are removed by the dealer, the retractable cover closes if no additional cards are necessary and remains open if additional cards are necessary. The card shuffler uses imaging means to track at least the rank of the cards being delivered to the dealing module and therefore is able to determine the game outcome and the need for none, one or both of the additional cards. If needed, the card shuffler automatically delivers one or both of the additional cards to the dealing area of the dealing module. If one or both the additional cards are not needed to complete the hand, they are used as part of the initial four cards of the next hand.

The various components and mechanisms tasked with delivering the cards to the dealing area of the dealing module and operating the retractable cover of the dealing module are set forth below in greater detail.

Other variations, embodiments and features of the present invention will become evident from the following detailed description, drawings and claims.

DETAILED DESCRIPTION

Figure 1:
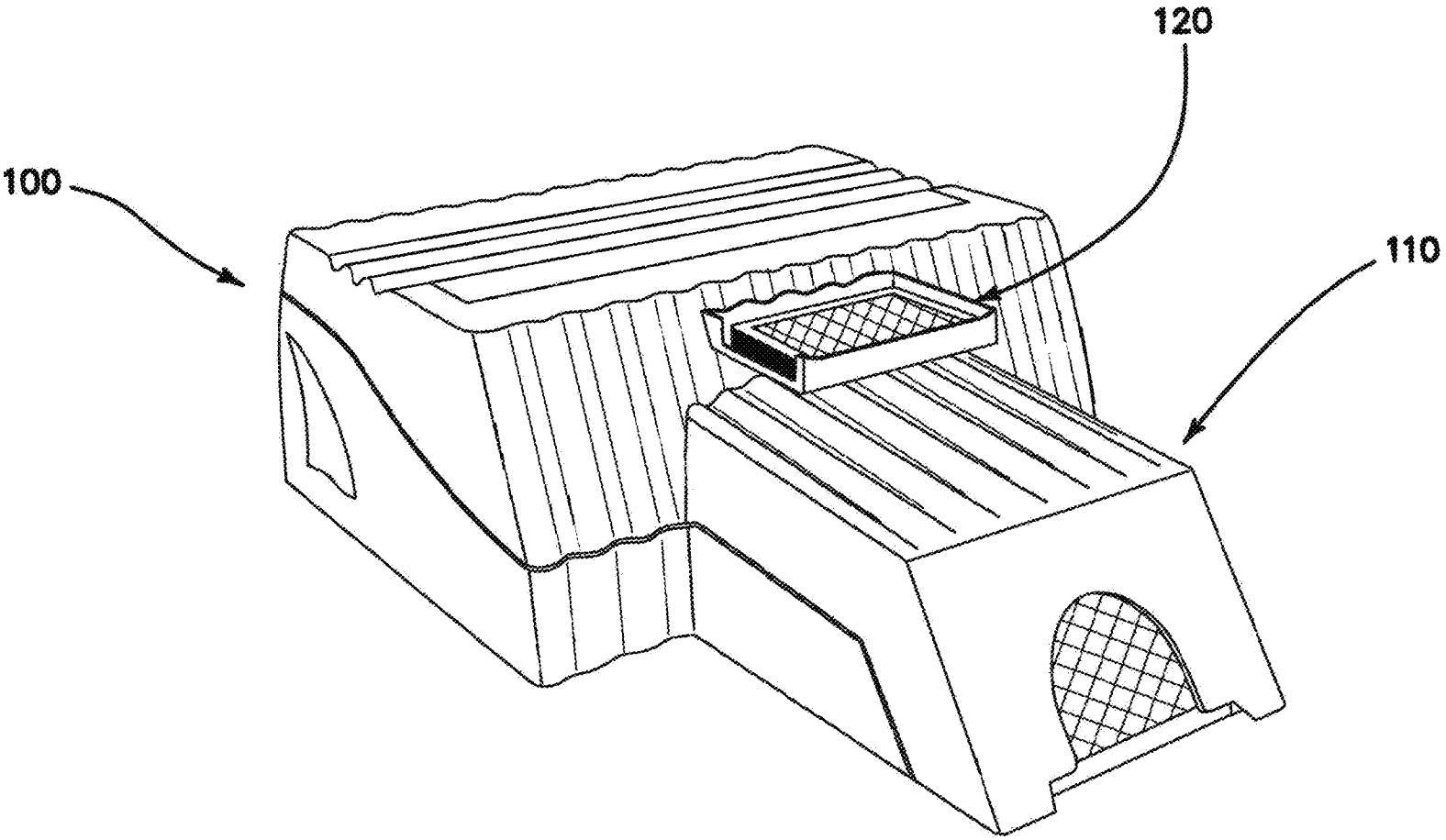
FIG. 1 illustrates a perspective upper view of an automatic card shuffler without the dealing module according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

As will be appreciated by one skilled in the art, the embodiments of the present invention combine software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

Computer program code for carrying out operations for embodiments of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The components of the embodiments of the present invention may be fabricated of any suitable materials, including, but not limited to, plastics, alloys, composites, resins and metals, and may be fabricated using suitable techniques, including, but not limited to, molding, casting, machining and rapid prototyping. The embodiments of the present invention are detailed below relative to the game of Baccarat (aka Punto Banco) but those skilled in the art will recognize that other card games may be dealt using the card shuffler and dealing module detailed herein.

Baccarat is a notoriously slow casino game, especially in respect to pregame procedures including pre-shuffle areas, pre-shuffled decks, inspecting new decks, washing the cards, changing decks, restarting dead games or other practices. Other procedures such as lids on baccarat shoes, burn card procedures and cut-card placement add time to the game. In some instances, such procedures and safety measures can be dangerous and create a false sense of security. For example, following the shuffling machine shuffle with a dealer courtesy hand shuffle opens the door to peek and stacking scams by the dealer. The embodiments of the present invention eliminate these problems and others.

Conventional Baccarat is based on scoring closest to nine points. Baccarat players are not wagering against the dealer or other players. There are two hands dealt from a dealing shoe usually consisting of eight decks of cards and the game progresses as follows: (i) wagers are placed on either the Player's or Banker's hand; (ii) two cards are dealt face up to each of the Player's hand and Banker's hand; (iii) a score is calculated for the Player's hand and the Banker's hand whereby tens and face cards are worth zero points, Aces are worth one point and all other cards are worth their face value; (iv) a determination is made whether either or both the Player's hand and/or Banker's hand is a natural (i.e., point total of 8 or 9); (v) if there is no natural hand, a determination is made whether the Player's hand should receive a third card based on standard rules (see below); (vi) a determination is made whether the banker's hand should receive a third card based on standard rules (see below); (vii) point totals for each hand are calculated and winner decided based on the hand having a point total closest to nine. A Player's hand receives no third card for two-card hand point totals of 6 and 7 or a Natural 8 or Natural 9 and receives a third card for a two-card hand point totals from 0-5 unless the banker has a Natural. If the Player's two-card hand point total is 6 or 7, the Banker's hand receives a third card for two-card hand point totals from 0-5 and unless the Player has a Natural, the Banker's hand receives a third card for two-card point totals of 0, 1 and 2. For all other totals, Table 1 details the procedure.

TABLE 1

| Banker's First Two Cards Total | Draw When Player's 3rd Card | Stands When Player's 3rd Card |
|---|---|---|
| 3 | 0, 1, 2, 3, 4, 5, 6, 7, 9 | 8 |
| 4 | 2, 3, 4, 5, 6, 7 | 0, 1, 8, 9 |
| 5 | 4, 5, 6, 7 | 0, 1, 2, 3, 8, 9 |
| 6 | 6, 7 | 0, 1, 2, 3, 4, 5, 8, 9 |
| 7 | Stand | Stand |
| 8, 9 | Natural (Neither Hand Draws) | Natural (Neither Hand Draws) |

All winning wagers are paid 1 to 1 while a tie bet (side bet) is paid 8 to 1. In one embodiment of the present invention, the card shuffler is programmed with the casino's specific Baccarat rules and is therefore able to determine the upcoming hand result and number of cards required before the Player's hand and Banker's hand are fully dealt or during the dealing process.

FIG. 1 shows an exemplary multi-deck card shuffler 100 with a traditional card shoe 110 attached thereto or integral therewith. A discard rack or tray 120 provides an input for placing dealt cards back into the card shuffler 100 for continuous shuffling.

Figure 2A:
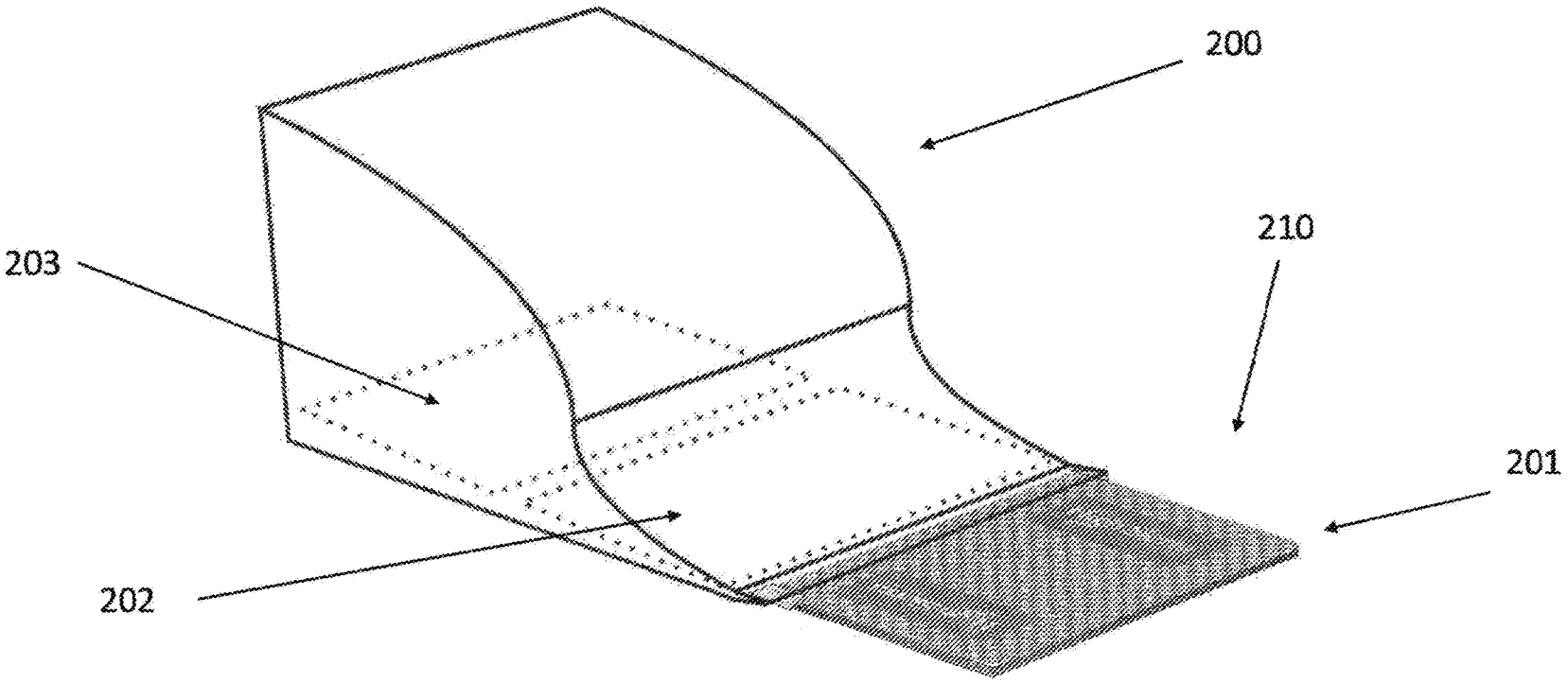
FIGS. 2A and 2B illustrate ornamental views of exemplary dealing modules according to the embodiments of the present invention.
Figure 2B:
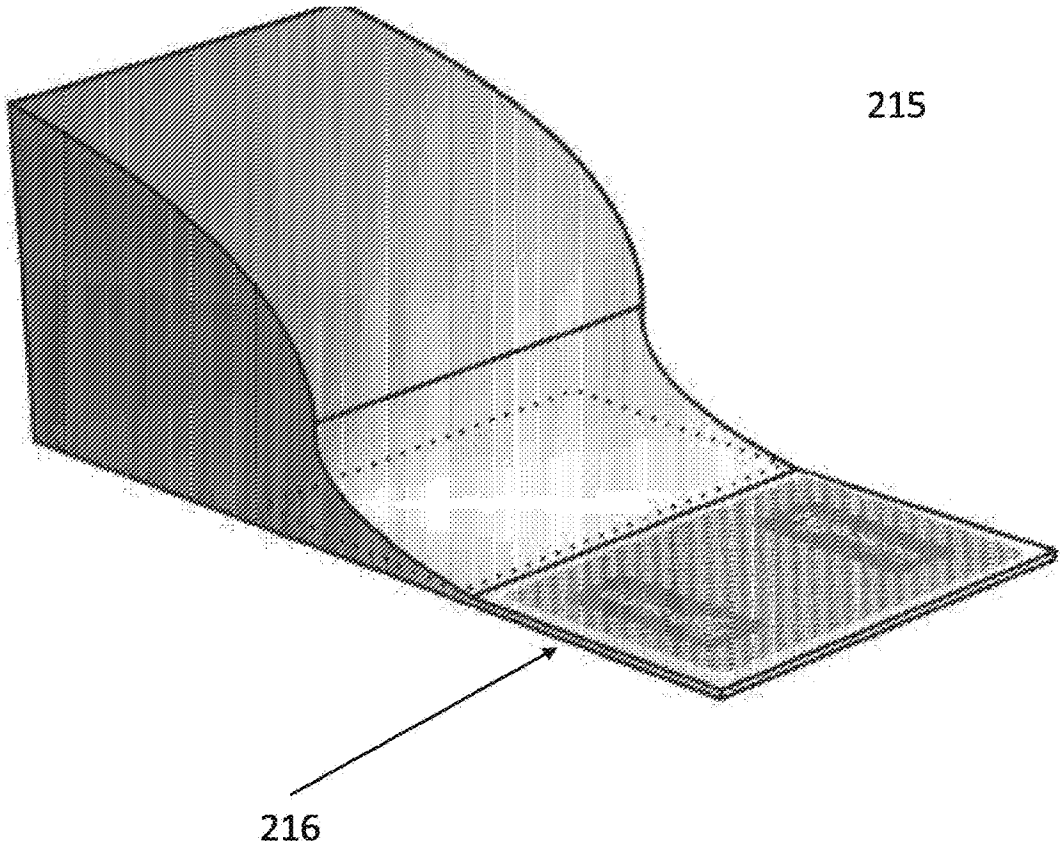

FIG. 2A shows an exemplary ornamental appearance of a dealing module 200, without a retractable cover, according to the embodiments of the present invention. The dealing module 200 is shaped to deliver the cards to a dealing area proximate a front portion of the dealing module. The four initial cards 201 are delivered to the dealing area 210, while the fifth card 202 is positioned rearward thereof and the sixth card 203 is positioned rearward thereof. With this embodiment, the four initial cards 201 rest on the card table. FIG. 2B shows an embodiment with the four initial cards 201 resting on a bottom surface 216 of the dealing module 215.

Figures 3A, 3B, 3C:
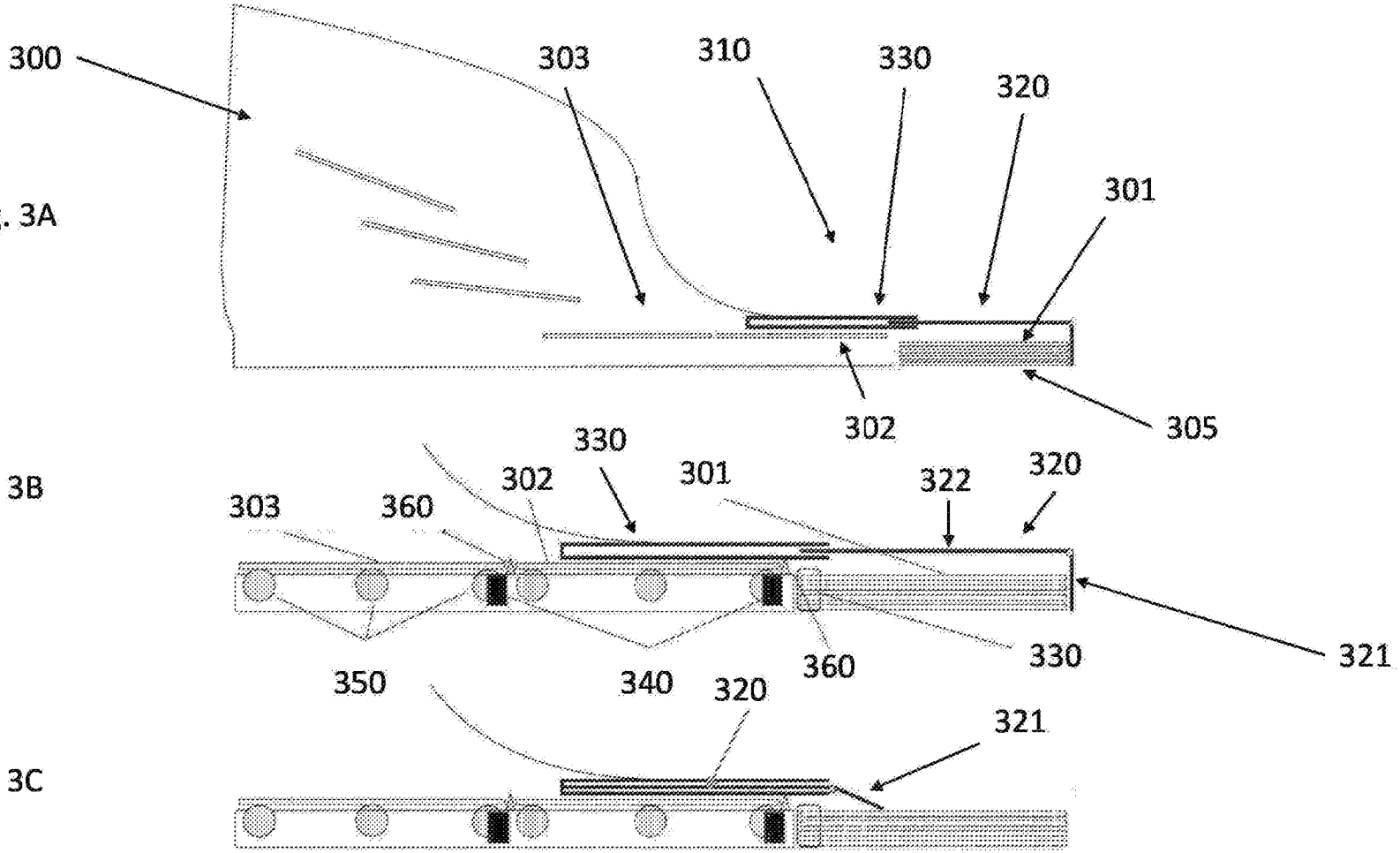
FIGS. 3A through 3C illustrate internal side views of the dealing module in operation according to the embodiments of the present invention.

FIG. 3A shows a side view of a card shuffler 300 with a dealing module 310 in place. The dealing module 310 includes the retractable cover 320 to conceal all cards until they are ready to be dealt to the players. In one embodiment, the retractable cover 320 is optically black to ensure that no IR/UV camera or other devices can see the cards in the dealing area of the dealing module. The retractable cover 320 is positioned to retract into a compartment 330 near an upper, internal surface of said dealing module 310. The retractable cover 320 is shown in a closed position in FIG. 3A concealing the four initial cards 301. A motor, servo or other device controls the movement of the retractable cover 320.

FIG. 3A shows the four initial cards 301 beneath the retractable cover 320 at the dealing area 305 between the retractable cover 320 and table on which the card shuffler 300 rests when in use. A fifth card 302 is positioned rearward of the four initial cards 301 and a sixth card 303 is positioned rearward of the fifth card 302

FIG. 3B shows a side view of one embodiment of the dealing module 310 with the retractable cover 310 closed. Holding tabs 330 serve to hold the initial four cards 301 in place with frictional resistance. Sensors 340 act to detect the presence of the initial cards 301, fifth card 302 and sixth card 303 in the dealing module 310. The sensors 340 may be optical, proximity, pressure, contact, etc., provided they are capable of detecting the presence of the initial cards 301, fifth card 302 and sixth card 303 in the dealing module 310. Rollers 350 serve to move the initial cards 301, fifth card 302 and sixth card 303 through the dealing module 310 once received from the shuffling process. Those skilled in the art will recognize that devices (e.g., belts) other than rollers 350 may be used to move the initial cards 301, fifth card 302 and sixth card 303 to the dealing area of the dealing module 310. Stops 360 maintain separation between the initial cards 301, fifth card 302 and sixth card 303 within the dealing module 310.

FIG. 3B also shows a front flap or door 321 movably hinged to a top 322 of the retractable cover 320. FIG. 3C shows a side view of one embodiment of the dealing module 310 with the retractable cover 310 open/retracted. As shown, as the retractable cover 320 moves open by translating partially into the compartment 330, the door 321 rotates responsive to contacting the four initial cards 301. The compartment accepts the top 322 and sides of the retractable cover 320 while the door 321 rotates and slides along the top of the cards beneath the retractable cover 320. The holding tabs 330 prevent the initial cards 301 from moving rearward when contacted by the door 321. In one embodiment, the door 321 is about 3/16" in height to accommodate up to ten stacked cards. Some Baccarat games burn up to ten cards before dealing so this is the greatest number of cards that the retractable cover 320 needs to accommodate for a Baccarat game. The door 321 may also be driven by a motor to open rather than by contacting the cards.

Figure 4:
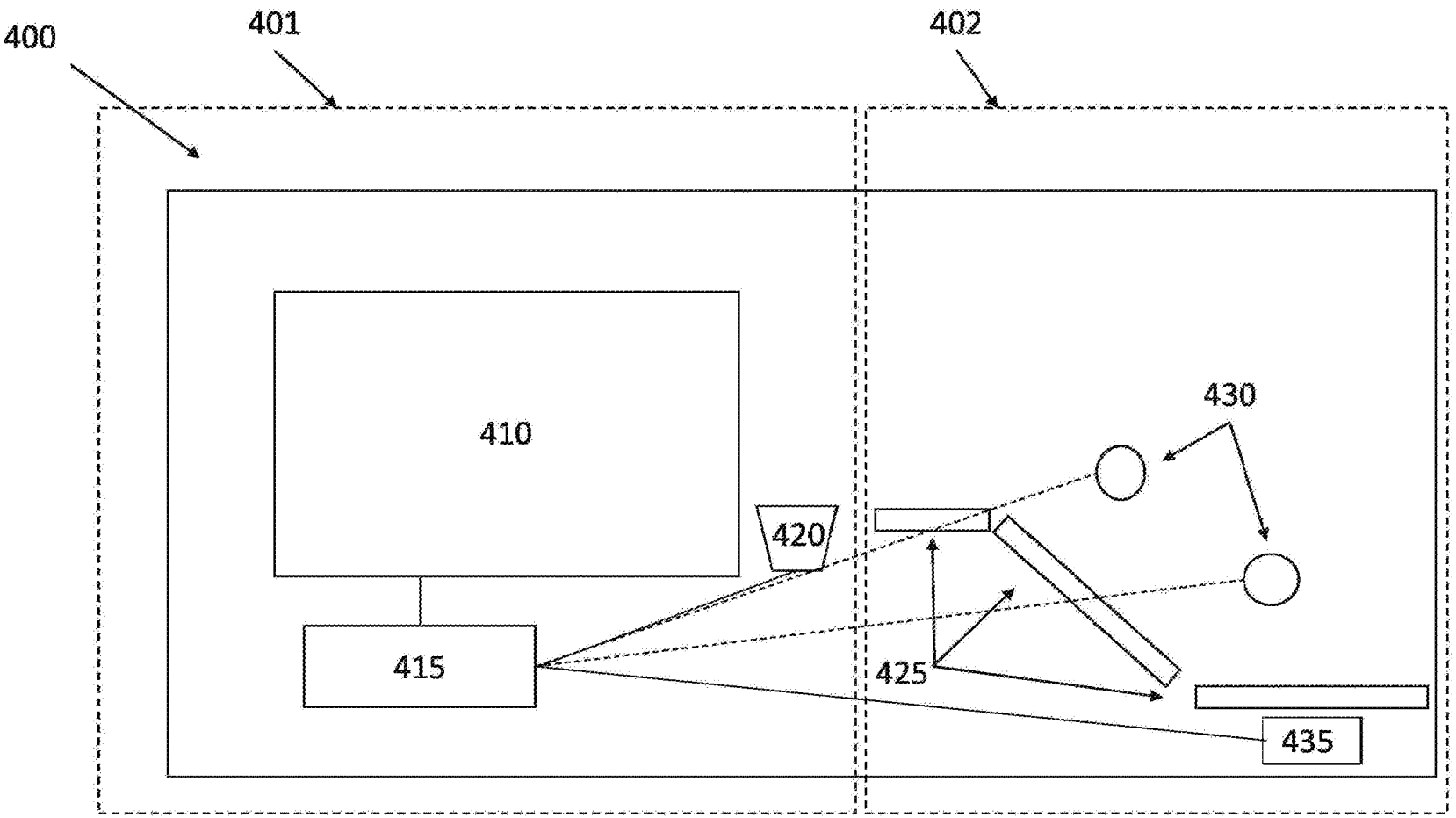
FIG. 4 illustrates a block diagram of the card shuffler and dealing module according to the embodiments of the present invention.

FIG. 4 shows a block diagram 400 of a card shuffler 401 and dealing module 402 according to the embodiments of the present invention. The card shuffler 401 includes random selection shuffling means 410 (e.g., as detailed in U.S. patent Ser. No. 10/092,820) controlled by a processor 415. Imaging means 420 capture the rank and optionally suit of each card as it is selected. Transport means 425 (e.g., rollers) are configured to move the cards through the dealing module 402. Sensors 430 detect card ranks and/or suits as well as the presence of cards in the dealing module 402. One or more motors 435 drive the transport means 425 and retractable cover.

Figure 5:
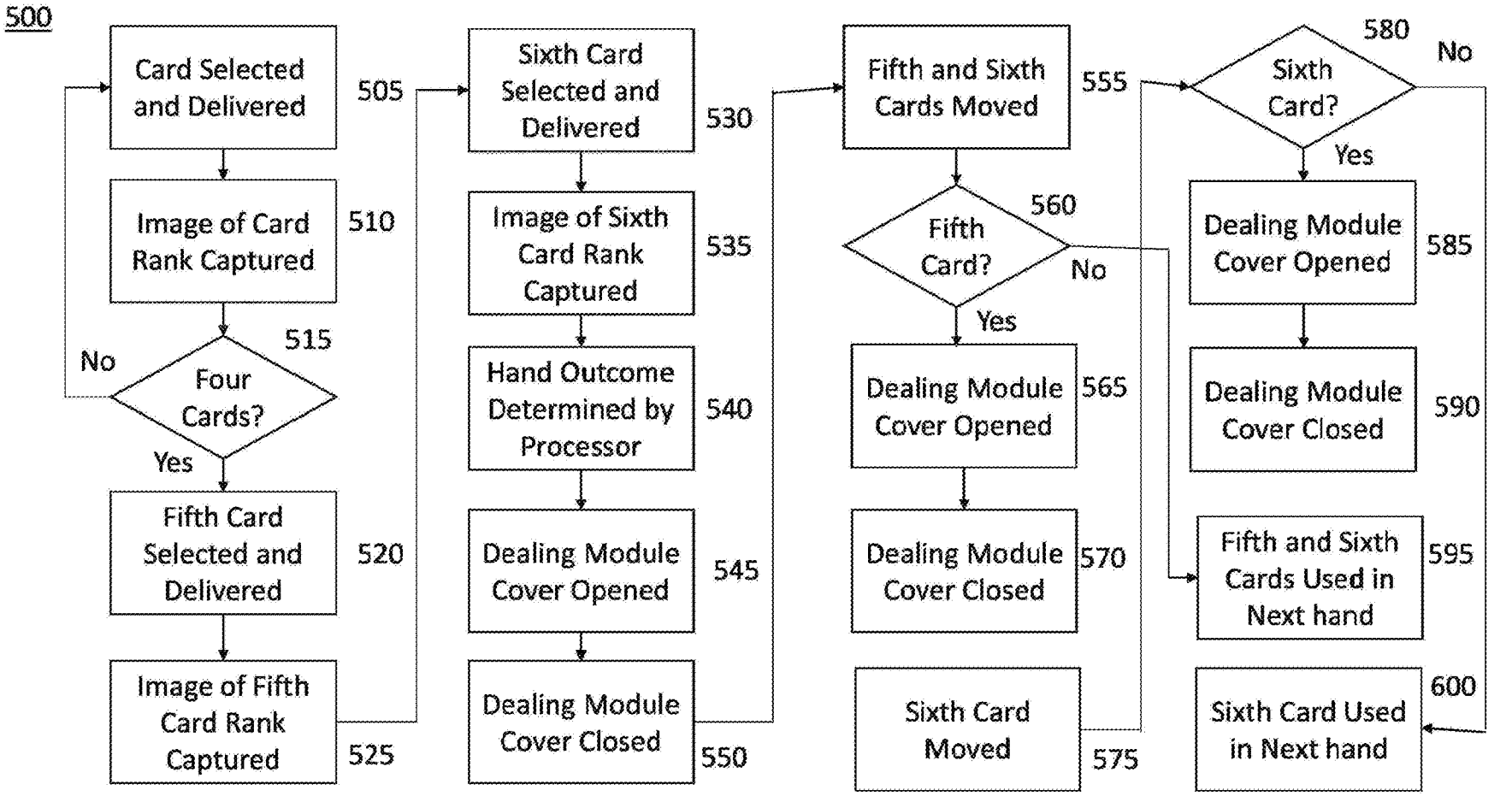
FIG. 5 illustrates a flow chart detailing a first methodology undertaken by the card shuffler and dealing module according to the embodiments of the present invention.

FIG. 5 shows a flow chart 500 detailing one methodology followed by the card shuffler and dealing module for the game of Baccarat. While Baccarat is described herein, the card shuffler and dealing module may be programmed to deal other table games as well. At 505, the card shuffler begins by randomly selecting and delivering the first of four initial Baccarat cards from the one or more stacks of unshuffled cards to the dealing area of the dealing module. At 510, an image of at least the rank of the first card is captured or identified by imaging means integrated in the card shuffler and/or dealing module. At 515, it is determined if the four initial cards for the Baccarat hand have been delivered to the dealing area of the dealing module. If not, the system loops back to 505 to select and deliver the next card. Once all four cards have been selected and delivered, at 520, the fifth card is selected and delivered from the one or more stacks of unshuffled cards to a position rearward of the dealing area in the dealing module now occupied by the four initial cards. At 525, the rank of the fifth card is captured or identified. At 530, the sixth card is selected and delivered from the one or more stacks of unshuffled cards to a position rearward of the fifth card in the dealing module. At 535, the rank of the sixth card is captured or identified. At 540, the card shuffler, via its processor, determines the Baccarat hand outcome based on the ranks of the six cards selected and delivered to the dealing module. This may occur before any cards are dealt to the players by the dealer or during the dealing process or afterwards. At 545, the dealing module cover is opened to allow the dealer access to the four initial cards. While the dealing module is shown opening after the fifth and sixth cards are in the dealing module, the dealing module cover may open any time after the four initial cards are delivered to the dealing area of the dealing module (i.e., while the fifth and sixth cards are being delivered to the dealing module). At 550, once the four cards are removed, the dealing module is closed responsive to a sensor output. At 555, the fifth card is moved, via the rollers, to the dealing area and the sixth card is moved to the area previously occupied by the fifth card via the rollers or other mechanisms. At 560, based on the hand outcome determination at 540, if the fifth card is needed, at 565 the dealing module cover opens to expose the fifth card and, at 570, the dealing module cover closes. If not needed, at 595, the fifth and sixth cards become part of the next Baccarat hand (i.e., the first two cards of the initial four cards of the next Baccarat hand). At 575, the sixth card is moved, via the rollers, to the dealing area of the dealing module. At 580, based on the hand outcome determination at 540, if the sixth card is needed, at 585 the dealing module cover opens to expose the sixth card and, at 590, the dealing module cover closes. If not needed, at 600, the sixth card becomes part of the next Baccarat hand (i.e., the first card of the initial four cards of the next Baccarat hand).

Figure 6:
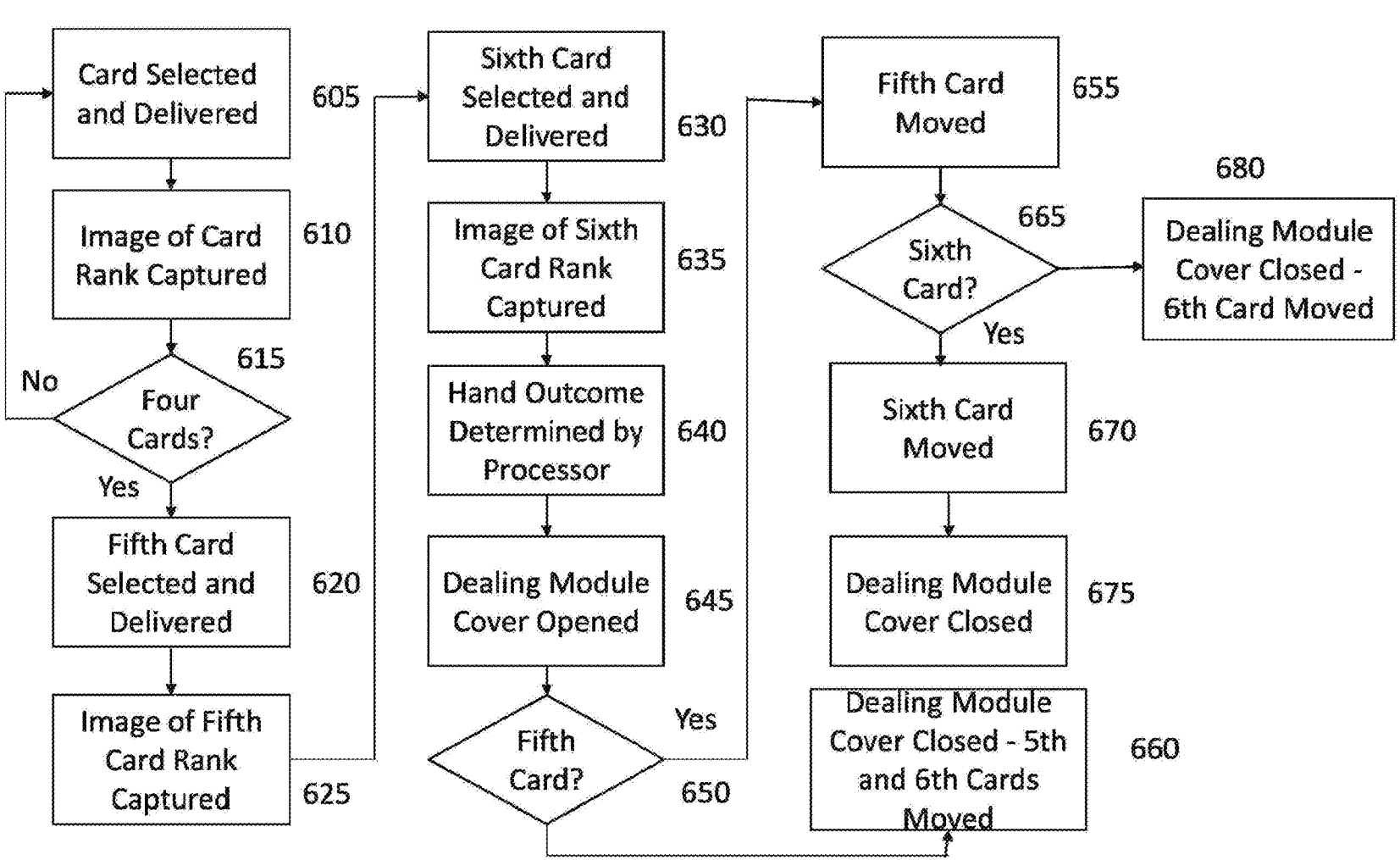
FIG. 6 illustrates a flow chart detailing a second methodology undertaken by the card shuffler and dealing module according to the embodiments of the present invention.

FIG. 6 shows a flow chart 700 detailing another methodology followed by the card shuffler and dealing module for the game of Baccarat. At 605, the card shuffler begins by randomly selecting and delivering the first of four initial Baccarat cards from the one or more stacks of unshuffled cards to the dealing area of the dealing module. At 610, an image of at least the rank of the first card is captured or identified by imaging means integrated in the card shuffler and/or dealing module. At 615, it is determined if the four initial cards for the Baccarat hand have been delivered to the dealing area of the dealing module. If not, the system loops back to 605 to select and deliver the next card. Once all four cards have been selected and delivered, at 620, the fifth card is selected and delivered from the one or more stacks of unshuffled cards to a position rearward of the dealing area in the dealing module now occupied by the four initial cards. At 625, the rank of the fifth card is captured or identified. At 630, the sixth card is selected and delivered from the one or more stacks of unshuffled cards to a position rearward of the fifth card in the dealing module. At 635, the rank of the sixth card is captured or identified. At 640, the card shuffler, via its processor, determines the Baccarat hand outcome based on the ranks of the six cards selected and delivered to the dealing module. This may occur before any cards are dealt to the players by the dealer or during the dealing process or afterwards. At 645, the dealing module cover is opened to allow the dealer access to the four initial cards. While the dealing module is shown opening after the fifth and sixth cards are in the dealing module, the dealing module cover may open any time after the four initial cards are delivered to the dealing area of the dealing module (i.e., while the fifth and sixth cards are being delivered to the dealing module). At 650, based on the hand outcome determination at 640, it is determined if the fifth card is needed, and if so, at 655 the fifth card is moved to the dealing area. If the fifth card is not needed, at 660, the dealing module cover closes and the fifth and sixth cards are moved to dealing area to become part of the next Baccarat hand (i.e., the first two cards of the initial four cards of the next Baccarat hand). At 665, based on the hand outcome determination at 640, it is determined if the sixth card is needed, and if so, at 670 the sixth card is moved to the dealing area. At 675 the cover closes as the Baccarat hand has been completely dealt. If, at 665, the sixth card is not needed, at 680, the dealing module cover closes and the sixth card is moved to dealing area to become part of the next Baccarat hand (i.e., the first card of the initial four cards of the next Baccarat hand).

The primary difference between the two methodologies detailed in FIGS. 5 and 6 is the operation of the retractable cover. The methodology of FIG. 5 comprises the retractable door closing between the initial four cards moving into the dealing area and the fifth card moving into the dealing and then again between the fifth card moving into the dealing area and the sixth card moving into the dealing area (or between the initial four cards moving into the dealing area and the fifth and sixth cards together moving into the dealing area) whereas the methodology of FIG. 6 comprises the retractable door remaining open until the hand is complete (i.e., all cards have been dealt for the hand). Those skilled in the art will recognize that the manner and order in which the retractable door opens and closes can be altered without departing from the spirit and scope of the embodiments of the present invention.

By way of reference, the four initial cards are enough to complete 38% of all Baccarat hands. When this occurs, after the four cards are removed from the dealing area of the dealing module, the cover closes so that the fifth and sixth cards may be moved to the dealing area along with two more randomly selected cards to finish the initial four cards for the next Baccarat hand. In this manner, the fifth and sixth cards are never visible to players when the retractable cover is open. Baccarat hands will require one draw card 30% of the time and two draw cards 32% of the time. Whether there are no draw cards, one draw card, or two draw cards, whatever is left in the queue is moved to the dealing area along with the number of randomly selected/shuffled cards required to establish four initial cards for the next Baccarat hand, followed by selecting/shuffling two additional cards that are moved into the fifth card position and sixth card position.

While the detailed description herein discloses the fifth and sixth cards being delivered to the dealing area of the dealing module one at a time, it is also suitable for the fifth and sixth cards, if needed, to be delivered to the dealing area simultaneously in a stacked arrangement. The system detailed herein may also be programmed to handle burns cards in the same manner as the game cards.

The benefits of the card shuffler and dealing module disclosed herein include increased game speed, increased game security and reduced card costs.

Since every card needs to be slid across the table to the proper dealing position only rather than being pushed down and out of a dealing shoe and then slid across the table to the proper dealing position, each Baccarat hand may be dealt faster and more efficiently. Applicant has determined that each card may be dealt about 0.05 seconds faster with the dealing module than with a traditional card shoe. Over the course of one year that works out to about 243 hours in savings per five Baccarat tables (i.e., about 50 hours in savings per Baccarat table). Given it takes approximately 1 hour to deal Baccarat hands from an eight-deck shoe, 243 more eight-deck shoes of Baccarat may be dealt at the five Baccarat tables. It is also easier for the dealers to simply slide the cards rather than pushing the cards from a traditional card shoe.

Game productivity is a significant parameter for casinos. The faster games are played, the more games that are played and the greater the theoretical hold over a given time frame. To that point, casinos have started ordering pre-shuffled decks of cards. Although pre-shuffled cards can only offer moderate gains in productivity by limiting shuffling time, the embodiments of the present invention eliminate 99% of all downtime caused by shuffling while also increasing dealing speed. Pre-shuffled cards have also been known to raise security concerns. First, there is no way to verify the decks of cards are complete without running the pre-shuffled decks of cards through a sorter, scanning device or shuffling machine with imaging capabilities. Second, there is no way to know with certainty that the pre-shuffled decks are randomly shuffled and free from biases, tampering, the memorization of one or more segments (i.e., slugs) or entire sets of shuffled decks (cooler). Consequently, pre-shuffled decks of cards do not provide absolute protection.

Even if a shuffler has a top card protection component, like a flap or brush, on the card shoe, absolute protection is not possible. These components only provide top card protection. The technology exists today to scan decks previously marked after the shuffle and during the cut before they are inserted into a dealing shoe Again, due to the random selection/shuffle, even this high-tech scam does not pose a threat. With random selection/shuffling with top card protection in the form of the dealing module and retractable cover, any information derived from cheaters or advantage players prior to inserting the cards into the card shuffler is rendered meaningless because the card shuffler does not deal the cards from any pre-shuffled order. The card shuffler randomly shuffles and deals at the same time ensuring that (a) each dealing order is unique, (b) each dealing order is independent of any pre-shuffle order, and (c) each card is randomly selected/shuffled one at a time, which means that no one knows which card is about to be selected, moved and dealt until about a millisecond after the shuffler's random number generator (RNG) selects the card number.

Significantly, the card shuffler and dealing module detailed herein protect against marked cards, scams that target manufacturing asymmetries, high-tech scams, peek and stack scams, unintentional and purposeful misdeals, and many more scams. Heretofore, casinos have tried using pre-shuffled decks of cards which as described above lack absolute protection.

Although the invention has been described in detail with reference to several embodiments, additional variations and modifications exist within the scope and spirit of the invention as described and defined in the following claims.

We claim:

1. A method of shuffling and presenting cards comprising:

utilizing a processor configured to control certain operations of an automatic card shuffler including random selection and movement of individual cards from a single stack of cards, said processor instructing said automatic card shuffler for:

randomizing said single stack of cards placed in an input area of said automatic card shuffler;

during a randomizing process, individually move each card from said single stack of cards from said input area to a first location until all cards in said single stack of cards have been moved to said first location thereby forming a single stack of randomized cards in the first location;

moving said single stack of randomized group of cards from said first location to a second location such that said single stack of randomized cards is positioned on a dealing area of a gaming table; and responsive to said stack of randomized cards being positioned on said dealing area of said gaming table, retracting a cover into a compartment of said automatic card shuffler to reveal said single stack of randomized cards positioned on said dealing area of said gaming table.

2. The method of claim 1 wherein said retractable cover includes a top, two sides and a door.

3. The method of claim 1 further comprising said processor instructing said automatic card shuffler for: once said single stack of cards is moved to said second location, randomizing a second single stack of cards placed in said input area of said automatic card shuffler and individually move each card forming said second single stack of cards from said input area to said first location until all cards in said second single stack of cards have been moved to said first location.

4. The method of claim 3 further comprising said processor instructing said automatic card shuffler for: moving said second single stack of cards to said second location once said single stack of cards is removed from said second location.

5. The method of claim 1 further comprising said processor instructing said automatic card shuffler for: moving said single stack of randomized group of cards from said first location to a second location using one or more belts and/or rollers.

6. A method of shuffling and presenting cards comprising:

utilizing a processor configured to control certain operations of an automatic card shuffler including random selection and movement of individual cards from a stacked deck of cards comprising 52 cards, said processor instructing said automatic card shuffler for:

randomizing said stacked deck of cards placed in an input area of said automatic card shuffler;

during a randomizing process, individually move each card forming said stacked deck of cards from said input area to a first location until all cards in said stacked deck of cards have been moved to said first location thereby forming a randomized stacked deck of cards in the first location;

moving said stacked randomized deck of cards from said first location to a second location such that said stacked randomized deck of cards is positioned on a dealing area of a gaming table; and responsive to said stack of randomized cards being positioned on said dealing area of said gaming table, retracting a cover into a compartment of said automatic card shuffler to reveal said single stack of randomized cards positioned on said dealing area on said gaming table.

7. The method of claim 6 wherein said retractable cover includes a top, two sides and a door.

8. The method of claim 6 further comprising said processor instructing said automatic card shuffler for: once said stacked deck of cards is moved to said second location, randomizing a second stacked deck of cards placed in said input area of said automatic card shuffler and individually move each card forming said second stacked deck of cards from said input area to said first location until all cards in said stacked second deck of cards have been moved to said first location.

9. The method of claim 8 further comprising said processor instructing said automatic card shuffler for: moving said second stacked deck of cards to said second location once said stacked deck of cards is removed from said second location.

10. The method of claim 6 further comprising said processor instructing said automatic card shuffler for: moving said randomized stacked deck of cards from said first location to a second location using one or more belts and/or rollers.

* * * * *